US009722350B1

(12) United States Patent
Baldwin

(10) Patent No.: US 9,722,350 B1
(45) Date of Patent: Aug. 1, 2017

(54) CONNECTOR TERMINAL AND METHOD OF ASSEMBLING THE SAME

(71) Applicant: Amphenol Corporation, Wallingford, CT (US)

(72) Inventor: Robert B. Baldwin, Grand Rapids, MI (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 15/350,509

(22) Filed: Nov. 14, 2016

(51) Int. Cl.

| | |
|---|---|
| ***H01R 4/66*** | (2006.01) |
| ***H01R 13/52*** | (2006.01) |
| ***H01R 4/30*** | (2006.01) |
| ***H01R 4/18*** | (2006.01) |
| ***H01R 11/26*** | (2006.01) |
| ***H01R 43/048*** | (2006.01) |
| ***H01R 43/00*** | (2006.01) |
| ***H01R 43/20*** | (2006.01) |
| ***H01R 43/26*** | (2006.01) |
| *H01R 103/00* | (2006.01) |

(52) U.S. Cl.
CPC ..... *H01R 13/5202* (2013.01); *H01R 4/18* (2013.01); *H01R 4/305* (2013.01); *H01R 11/26* (2013.01); *H01R 13/5205* (2013.01); *H01R 43/005* (2013.01); *H01R 43/048* (2013.01); *H01R 43/20* (2013.01); *H01R 43/26* (2013.01); *H01R 2103/00* (2013.01)

(58) Field of Classification Search
CPC .. H01R 13/65802; H01R 4/64; H01R 3/2421; H01R 13/052
USPC ..... 439/95, 825, 843, 92, 620
See application file for complete search history.

(56) References Cited

U.S. PATENT DOCUMENTS

| | | | | |
|---|---|---|---|---|
| 3,216,661 | A * | 11/1965 | Sawyer | F23N 1/022 236/15 E |
| 4,738,628 | A * | 4/1988 | Rees | H01R 13/648 439/332 |
| 5,181,860 | A * | 1/1993 | Honma | H01R 13/639 285/82 |
| 7,467,978 | B2 | 12/2008 | Sundermeier | |
| 7,914,298 | B2 | 3/2011 | Lauermann et al. | |

(Continued)

FOREIGN PATENT DOCUMENTS

| | | | |
|---|---|---|---|
| EP | 1283564 | A1 | 2/2003 |
| GB | 1518406 | A | 7/1978 |
| WO | WO-2016087685 | A1 | 6/2016 |

*Primary Examiner* — Phuongchi T Nguyen
(74) *Attorney, Agent, or Firm* — Blank Rome LLP; Charles R. Wolfe, Jr.; Tara L. Marcus

(57) ABSTRACT

A connector terminal with a unit-mountable connector of that includes a connector body having an adapter engagement end and a unit engagement end, and a mounting member therebetween for mounting the connector body to a unit. An insert extends through the connector body and has an inner bore extending between a cable interface end and a unit interface end, and a connector body interface portion between the ends. One or more double-sided contacts are received in the insert. The double-sided contact is one-piece with one end that is a cable termination end configured to terminate to a conductor of a cable and an opposite end that is a unit termination end configured to terminate to a conductor of the unit. The unit-mountable connector is adapted to mate with a cable sealing adapter. The cable sealing adapter is devoid of contact.

31 Claims, 5 Drawing Sheets

(56) References Cited

U.S. PATENT DOCUMENTS

| | | | | |
|---|---|---|---|---|
| 8,777,658 | B2 * | 7/2014 | Holland | H01R 24/46<br>439/578 |
| 9,178,303 | B2 | 11/2015 | Franke et al. | |
| 2010/0260456 | A1 | 10/2010 | Alcaraz et al. | |
| 2015/0364854 | A1 | 12/2015 | Lindkamp | |
| 2016/0006162 | A1 | 1/2016 | Andresen et al. | |

* cited by examiner

CONNECTOR TERMINAL AND METHOD OF ASSEMBLING THE SAME

FIELD OF THE INVENTION

The present invention relates to a connector terminal, such as an outdoor gland terminal, and method for assembling the same.

BACKGROUND OF THE INVENTION

Integrating electrical connectors into product designs or units is often complicated and costly, particularly for outdoor applications where environmental sealing and ruggedness is required. The cables of these connectors are typically pre-terminated to a connector component instead of being field installable. That is particularly cumbersome and costly when dealing with long and heavy cables which are large and expensive to ship to site.

Therefore, a need exists for a connector terminal that can be easily integrated into a unit and allows field installation of the cables at a reduced cost while also providing ruggedness and environmental sealing for outdoor applications.

SUMMARY OF THE INVENTION

Accordingly, the present invention may provide a unit-mountable connector that comprises a connector body that has an adapter engagement end and a unit engagement end opposite the adapter engagement end, and a mounting member therebetween for mounting the connector body to a unit. An insert extends through the connector body. The insert has an inner bore that extends between a cable interface end and a unit interface end opposite the cable interface end. A connector body interface portion is between the cable interface and unit interface ends. At least one double-sided contact is received in the inner bore of the insert. The double-sided contact may be one-piece with one end that is a cable termination end configured to terminate to at least one conductor of a cable and an opposite end that is a unit termination end configured to terminate at least one conductor of the unit. In a preferred embodiment, the cable termination end and the unit termination end are different types of termination.

The present invention may also provide a connector terminal that comprises a unit-mountable connector that includes a connector body that has an adapter engagement end and a unit engagement end opposite the adapter engagement end, and a mounting member therebetween for mounting the connector body to a unit. An insert extends through the connector body. The insert has an inner bore that extends between a cable interface end and a unit interface end opposite the cable interface end. A connector body interface portion is between the cable interface and unit interface ends. At least one double-sided contact is received in the inner bore of the insert. A cable sealing adapter is mateable with the unit-mountable connector. The cable sealing adapter includes a housing that has a mating end configured to engage the adapter engagement end of the connector body and receive the cable interface end of the insert and a cable securing end opposite the mating end. The cable securing end is configured to terminate a cable. The cable sealing adapter is devoid of any contacts. The double-sided contact of the unit-mountable connector may be one-piece with one end that is a cable termination end configured to terminate to at least one conductor of the cable supported by the cable sealing adapter and an opposite end that is a unit termination end configured to terminate at least one conductor of the unit. In a preferred embodiment, the connector terminal is a power terminal and the cable is a power cable.

The present invention may further provide a method of assembling a connector terminal to a unit, the connector terminal including a unit-mountable connector and a cable sealing adapter, comprising the steps of: terminating at least one conductor of the unit to a unit interface end of a double-sided contact of the unit-mountable connector; mounting a connector body of the unit-mountable connector to the unit; installing a connector cable by terminating at least one conductor of the connector cable to a cable interface end of the double-sided contact of the unit-mountable connector opposite the unit interface end of the double-sided contact; and assembling the cable sealing adapter on the connector cable after the step of installing the connector cable and mating an end of the cable sealing adapter with the connector body of the unit-mountable connector such that a cable interface end of the unit-mountable connector is received in the cable sealing adapter.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing figures.

DETAILED DESCRIPTION OF THE INVENTION

Referring to FIGS. 1-6, the present invention relates to a connector terminal 10, such as a power terminal, and a method of assembling the same, particularly on a unit, such as a telecom radio unit. The connector terminal of the present invention is designed to have field-installable capability which allows termination of a cable, such as a power cable, to be done on site rather than requiring the use of a pre-terminated cable assembly or wire harness. That is particularly beneficial when dealing with long and heavy cables which are large and expensive to ship to site. The present invention eliminates the workspace and electrical connections required to terminate a cable outside of the unit's enclosure, thereby allowing reduced sizing and increased connector ruggedness. This design also allows the use of standard tools for conductor termination instead of specialty tools. Although the connector terminal of the present invention is preferably used for power applications, the connector terminal 10 may also be used for other applications, such as signal.

Figure 5:
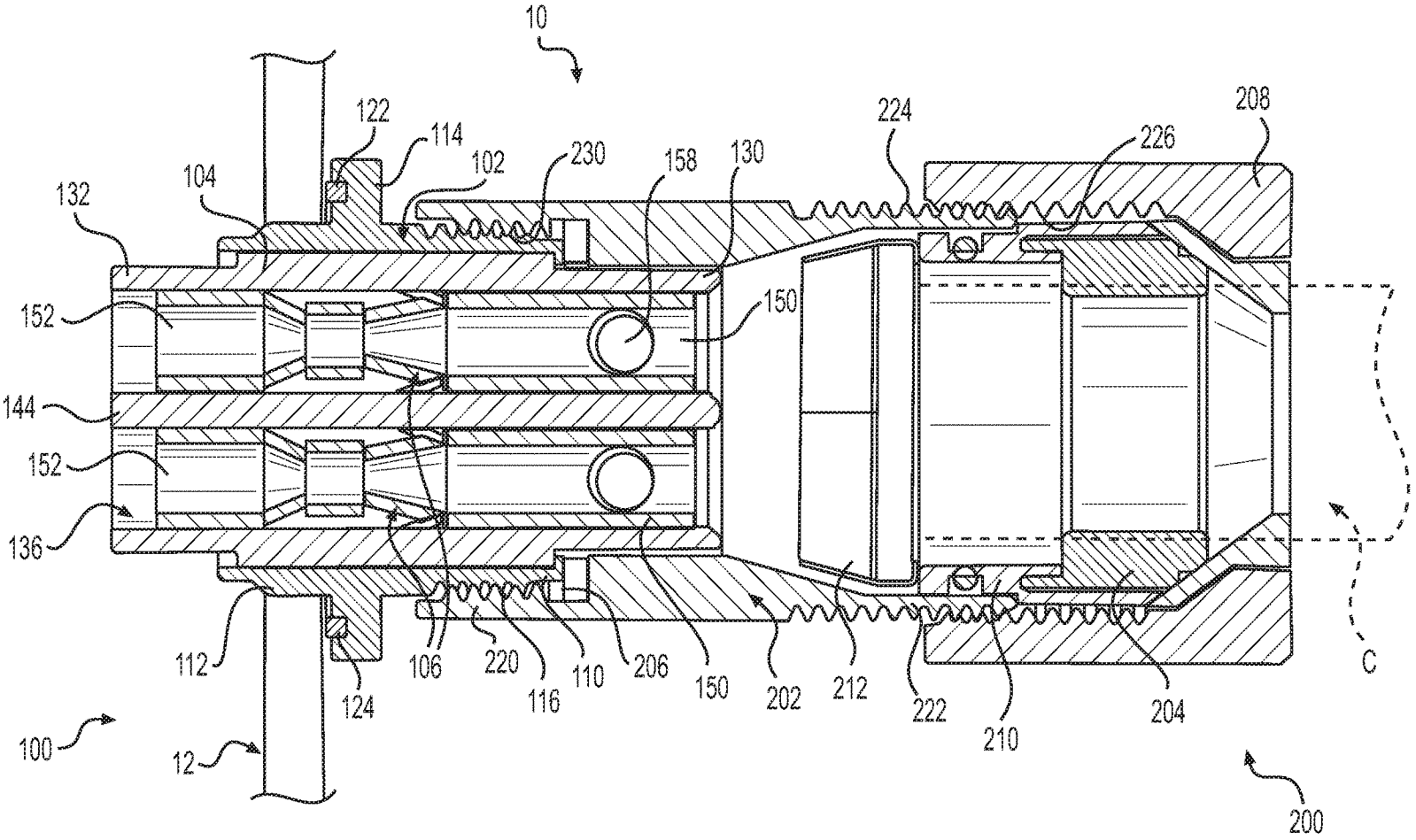
FIG. 5 is a cross-sectional view of the connector terminal assembly illustrated in FIG. 1, showing the connector terminal mounted to a unit.

Connector terminal 10 includes a unit-mountable connector 100 that mates with a cable sealing adapter 200. Unit-mountable connector 100 is configured to mount to an enclosure or panel 12 (FIG. 5) of a unit. Cable sealing adapter 200 terminates and environmentally seals a cable C (FIG. 5). When unit-mountable connector 100 and cable sealing adapter 200 are mated, an electrical and a mechanical connection is provided between the unit and the cable C.

Figure 3:
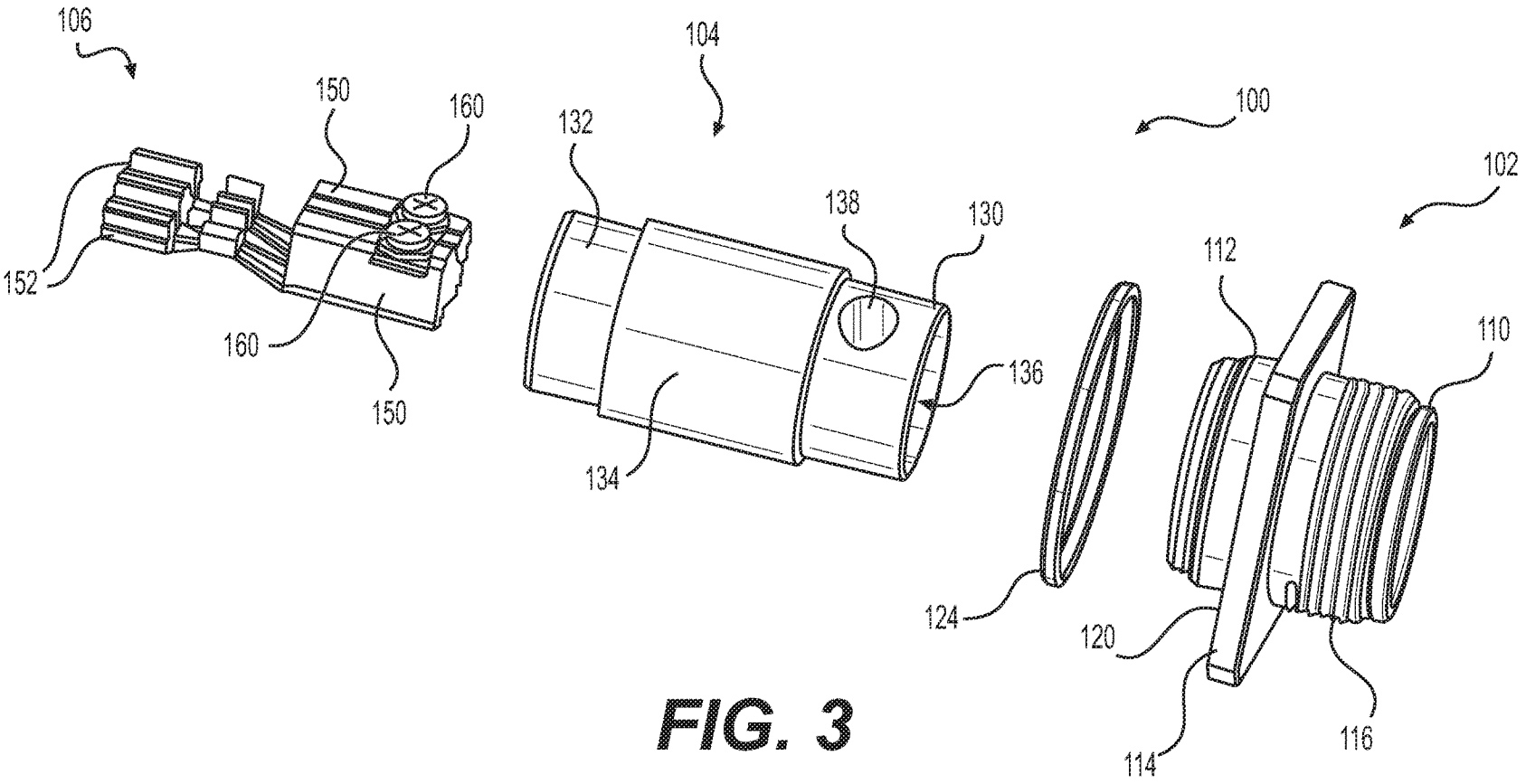
FIG. 3 is an exploded perspective view of the unit-mountable connector illustrated in FIG. 2.

As seen in FIG. 3, unit-mountable connector 100 generally includes a connector body 102, an insert 104 received in connector body 102, and one or more double-sided contacts 106 received in insert 104. Connector body 102 may include an adapter engagement end 110 that interfaces with cable sealing adapter 200, an opposite unit mountable end 112 that interfaces with the unit, and a mounting member 114 therebetween. Connector body 102 may be generally cylindrical in shape, except for mounting member 114. Adapter engagement end 110 preferably includes outer threads 116 for engaging cable sealing adapter 200. Although threads are preferred, adapter engagement end 110 may include any known type of attachment, such as a bayonet engagement.

Figure 1:
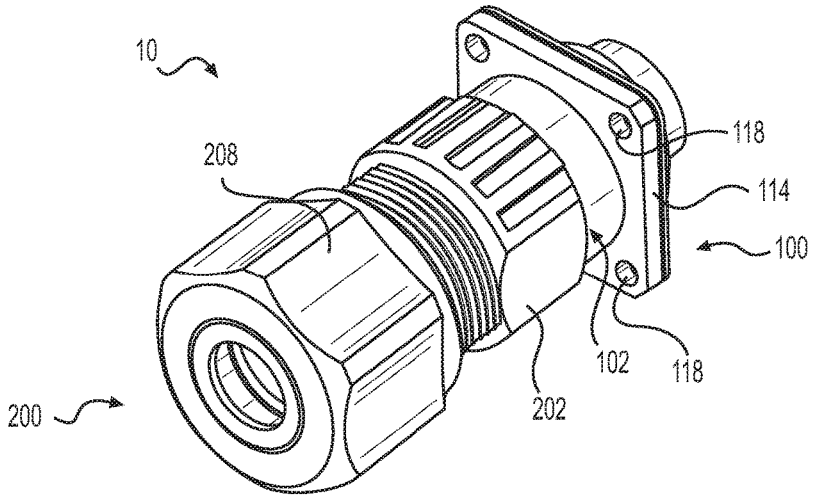
FIG. 1 is a perspective view of a connector terminal according to an exemplary embodiment of the present invention.
Figure 2:
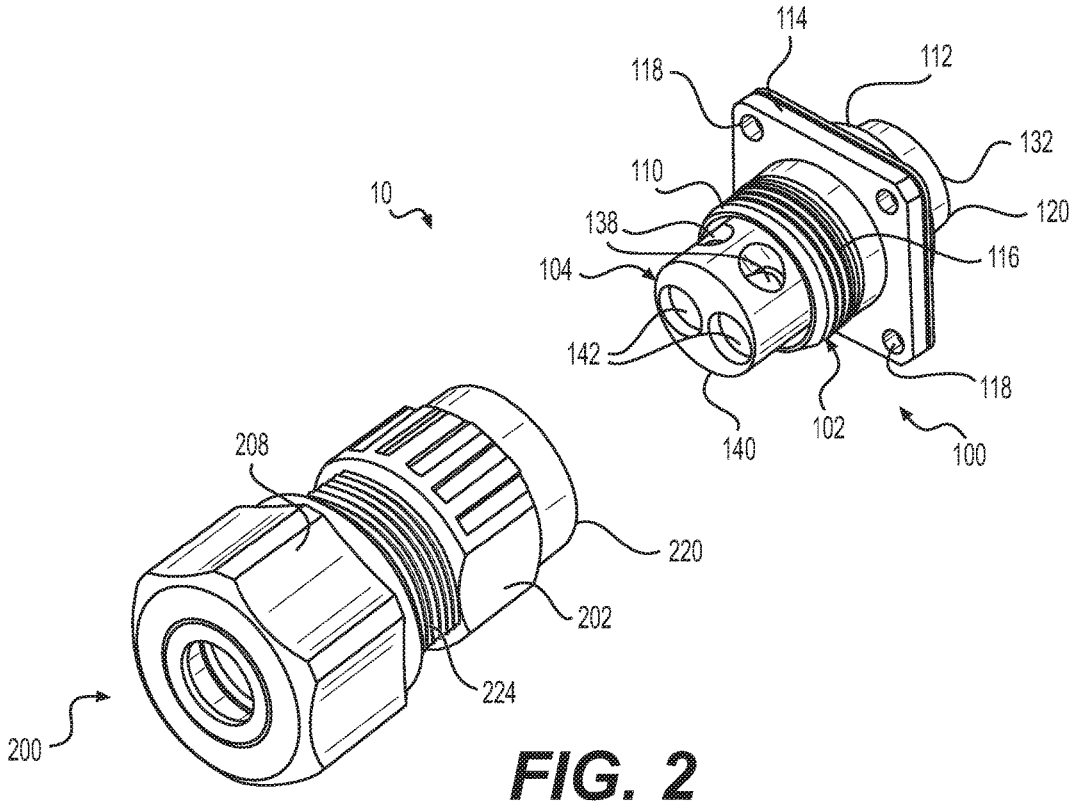
FIG. 2 is an exploded perspective view of the connector terminal illustrated in FIG. 1, showing a unit-mountable connector that mates with a cable sealing adapter.

Mounting member 114 is preferably an outwardly extending flange, as best seen in FIGS. 1 and 2. One or more mounting holes 118 may be provided in mounting member 114 for receiving a fastener to mount connector body 102 to the panel or enclosure 12 of the unit. Mounting member 114 may be any shape, such as substantially square, as long as one or more of the mounting holes 118 are provided. Mounting member 114 includes a mounting surface 120 that faces the unit mountable end 112 for abutting the unit's panel or enclosure 12 when unit-mountable connector 100 is mounted thereon. In a preferred embodiment, mounting surface 120 of mounting member 114 includes an annular groove 122 that receives a sealing member 124, such as an O-ring or gasket.

Figure 6:
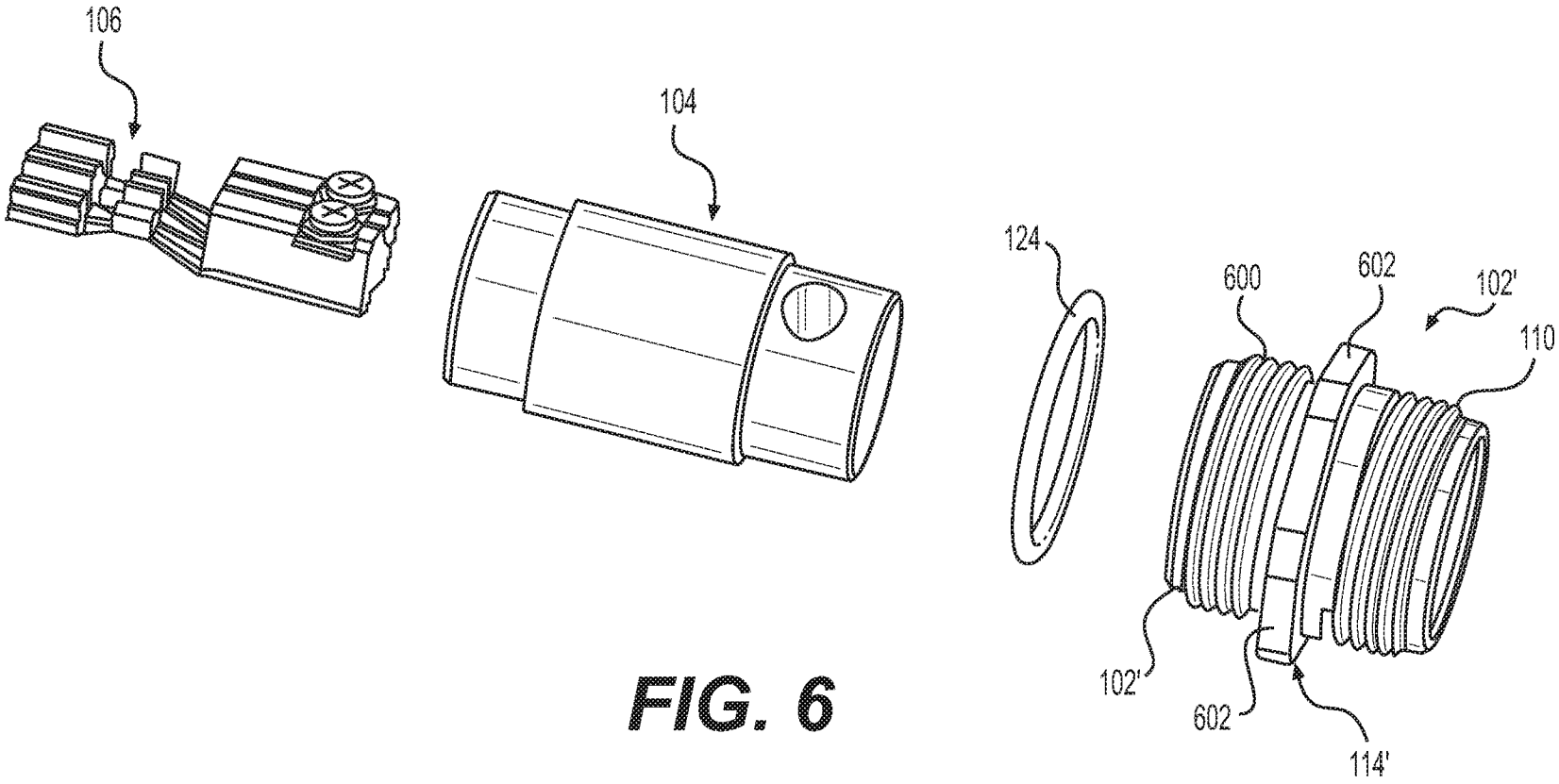
FIG. 6 is an exploded perspective view of a unit-mountable connector according to an alternative embodiment of the present invention.

FIG. 6 illustrates an alternative design for a connector body 102' of unit-mountable connector 100. Connector body 102' is similar to connector body 102 of the embodiment above, except that connector body 102' is threadably mounted to the unit and not bolted to the unit. Like connector body 102 of the embodiment above, connector body 102' includes adapter engagement end 110 with outer threads for engaging cable sealing adapter 200. Unlike connector body 102 of the embodiment above, the unit engagement end 112' of connector body 102' also includes outer threads 600 for threadably engaging the panel or enclosure 12 of the unit. Connector body 102' includes a mounting member 114' that is an outwardly extending flange like the mounting member 114 of the embodiment above. Mounting member 114' preferably includes a number of gripping faces 602 for facilitating rotation and application of torque to connector body 102' when mounting connector body 102' to the unit's panel or enclosure 12 via threads 600.

Insert 104 is received in and extends through connector body 102. Insert 104 generally includes a cable interface end 130, an opposite unit interface end 132, and a connector body interface portion 134 therebetween. Cable interface end 130 extends through and beyond adapter engagement end 110 of connector body 102, unit interface end 132 extends through and beyond unit engagement end 112 of connector body 102, and connector body interface portion 134 is received inside of connector body 102. An inner bore 136 of insert 104 extends between those ends and supports double-sided contacts 106. As seen in FIGS. 2 and 3, cable interface end 130 of insert 104 includes one or more holes 138 located outside of connector body 102 allowing access to double-sided contacts 106. An end face 140 of cable interface end 130 may include one or more openings 142 (FIG. 2) also providing access to double-sided contacts 106.

Inner bore 136 of insert 104 is preferably substantially cylindrical and may include one or more dividers 144 to divide inner bore 136 into a plurality of compartments where each compartment supports an individual double-sided contact 106, as seen in FIG. 5.

Each double-sided contact 106 includes opposite termination ends, one end being a cable termination end 150 and the other end being a unit termination end 152. Each double-sided contact 106 is preferably one-piece or integrally formed. Cable termination end 150 is configured to electrically and mechanically connect to and terminate a conductor of a cable C and unit termination end 152 is configured to electrically and mechanically connect to and terminate a conductor of the unit. In a preferred embodiment, cable termination end 150 and unit termination end 152 are different types of termination mechanisms. For example, cable termination end 150 may be a clamp termination where end 150 is clamped, via either a spring clamp or clamp fastener, such as screw 160, onto the conductor of the cable C and unit termination end 152 may be a crimp termination where end 152 is crimped onto the conductor of the unit. Alternatively, cable termination end 150 and unit termination end 152 may be the same type of termination mechanism. Where cable termination end 150 uses clamp fastener like screw 160, screw 160 may be easily inserted from outside of unit-mountable connector 100 through the hole 138 into the insert's inner bore 136 through a corresponding hole 158 (FIG. 5) in double-sided contact 106 to clamp cable termination end 150 of double-sided contact 106 onto the conductor of the cable C.

Figure 4:
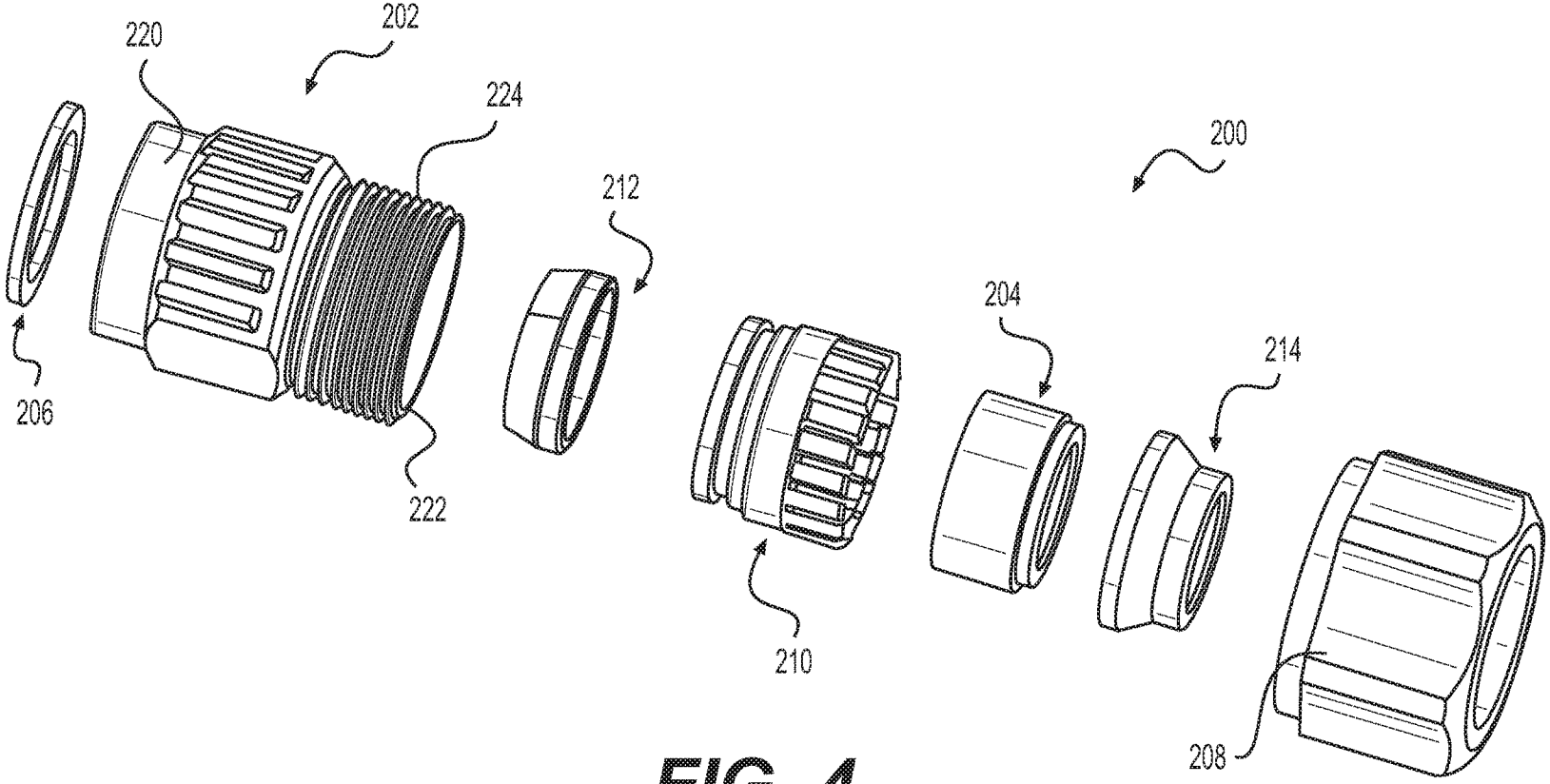
FIG. 4 is an exploded perspective view of the cable sealing adapter illustrated in FIG. 2.

As seen in FIG. 4, cable sealing adapter 200 generally includes a housing 202, a main sealing member 204 for sealing the cable C, such as a wide cable sealing gasket, a secondary sealing member 206, such as an O-ring or gasket, received in housing 202, and a compression nut 208. Cable sealing adapter 200 may also include a cable gasket compressor 210, a cable shielding ring 212, and a cable reducer 214. Housing 202 may be generally cylindrical with a mating end 220 that is configured to engage adapter engagement end 110 of connector body 102 and receive cable interface end 130 of insert 104. In a preferred embodiment, inner threads 230 of mating end 220 engage outer threads 116 of connector body 102. Opposite mating end 220 is a cable securing end 222 that is configured to terminate the cable C. Cable securing end 222 may include outer threads 224 that engage corresponding threads 226 (FIG. 5) of compression nut 208 to facilitate the advancement of compression nut 208 onto housing 202 for compressing main sealing member 204 and cable gasket compressor 210 to terminate a prepared end of the cable C. Any known attachment other than threads may be used to advance nut 208 onto housing 202, such as a bayonet attachment.

Connector terminal 10 may be assembled by first electrically and mechanically connecting unit engagement end 112 of unit-mountable connector 100 to the unit's panel or enclosure 12. To do so, the one or more conductors of the unit are terminated, such as by crimping, to the unit interface end 152 of each double-sided contact 106 of unit-mountable connector 100. This step preferably occurs inside of the unit. Unit engagement end 112 of connector body 102 is sized to be received in and extend through an opening in the unit's panel or enclosure, as seen in FIG. 5. Then connector body 102 of unit-mountable connector 100 may be mounted to the unit. Fasteners, such as bolts, may be extended through mounting holes 118 in mounting flange 114 and into the unit's panel or enclosure 12 to complete the mounting of unit-mountable connector 100. Alternatively, the connector body may be threadably mounted to the unit's panel or enclosure 12 via threads 600 (FIG. 6). When mounted, the mounting surface 120 of mounting member 114 along with sealing member 124 abut or nearly abut the unit's panel or enclosure 12.

Once unit-mountable connector 100 is mounted on the unit, the cable C may be terminated thereto by terminating, such as by clamping via a screw or spring clamp, each of the conductors of the cable C to cable interface end 150 of each double-sided contact 106 of the unit-mountable connector 100. Because unit-mountable connector 100 includes contacts 106 that are double-sided for termination, no corresponding contacts are required for cable sealing adapter 200. Thus, cable sealing adapter 200 is devoid of any contacts. The step of installing the cable C preferably occurs outside the unit.

Cable sealing adapter 200 may then be assembled onto the cable C and mated to cable engagement end 110 of unit-mountable connector 100. Compression nut 208 is advanced onto housing 202 of cable sealing adapter 200 to terminate and seal the prepared end of the cable C. And the mating end 220 connects with cable engagement 110 of connector body 102 of unit-mountable connector 100 such that cable interface end 130 of insert 104 of unit-mountable connector 100 is received in mating end 220, to secure cable sealing adapter 200 to unit-mountable connector 100.

While particular embodiments have been chosen to illustrate the invention, it will be understood by those skilled in the art that various changes and modifications can be made therein without departing from the scope of the invention as defined in the appended claims. For example, although the connector terminal of the present invention is preferably used for outdoor applications with appropriate environmental sealing, the connector terminal may also be used for indoor applications with or without the environmental sealing.

What is claimed is:

1. A unit-mountable connector, comprising:

a connector body having an adapter engagement end and a unit engagement end opposite said adapter engagement end, and a mounting member there between for mounting the connector body to a unit;

an insert extending through on said connector body, said insert having an inner bore extending between a cable interface end and a unit interface end opposite said cable interface end, and a connector body interface portion between said cable interface and unit interface ends; and at least one double-sided contact received in said inner bore of said insert, said double-sided contact being one-piece with one end that is a cable termination end configured to terminate to at least one conductor of a cable and an opposite end that is a unit termination end configured to terminate at least one conductor of the unit;

wherein said cable termination end is a clamp termination and said unit termination end is a crimp termination;

wherein said cable interface end of said insert includes at least one hole that receives a clamp fastener, and said clamp fastener engages said clamp termination of said double-sided contact;

wherein said mounting member includes a groove in a mounting surface thereof that receives a sealing member, said mounting surface faces said unit engagement end of said connector body;

wherein said cable interface end of said insert extends through and beyond said adapter engagement end of said connector body; and said unit interface end of said insert extends through and beyond said unit engagement end of said connector body.

2. A unit-mountable connector according to claim 1, wherein said cable termination end of said double-sided contact is different than said unit termination end.

3. A unit-mountable connector according to claim 1, wherein said inner bore includes a divider dividing said inner bore into a plurality of compartments, and said double-sided contact is received in one of said plurality of compartments; and another double-sided contact that has one end that is a cable termination end configured to terminate to at least one conductor of the cable and an opposite end that is a unit termination end configured to terminate at least one conductor of the unit, is received in another of said plurality of compartments.

4. A unit-mountable connector according to claim 3, wherein said inner bore of said insert is substantially cylindrical.

5. A unit-mountable connector according to claim 1, wherein said adapter engagement end of said connector body includes outer threads for engaging corresponding threads of an adapter; and said unit engagement end of said connector body is sized for extending through an opening in the unit.

6. A unit-mountable connector according to claim 5, wherein said unit engagement end includes outer threads for engaging corresponding threads of the unit.

7. A unit-mountable connector according to claim 1, wherein said mounting member is an outwardly extending flange.

8. A unit-mountable connector according to claim 7, wherein said flange includes at least one mounting hole for receiving a fastener.

9. A unit-mountable connector according to claim 7, wherein said flange includes gripping faces for facilitating application of torque to said flange.

10. A connector terminal, comprising:

a unit-mountable connector including, a connector body having an adapter engagement end and a unit engagement end opposite said adapter engagement end, and a mounting member therebetween for mounting the connector body to a unit, an insert extending through said connector body, said insert having an inner bore extending between a cable interface end and a unit interface end opposite said cable interface end, and a connector body interface portion between said cable interface and unit interface ends, and at least one double-sided contact received in said inner bore of said insert; and a cable sealing adapter mateable with said unit-mountable connector, said cable sealing adapter including a housing having a mating end configured to engage said adapter engagement end of said connector body and receive said cable interface end of said insert and a cable securing end opposite said mating end, said cable securing end being configured to terminate a cable, and said cable sealing adapter being devoid of any contacts, wherein said double-sided contact of said unit-mountable connector is one-piece with one end that is a cable termination end configured to terminate to at least one conductor of the cable supported by said cable sealing adapter and an opposite end that is a unit termination end configured to terminate at least one conductor of the unit;

wherein said cable termination end is a clamp termination and said unit termination end is a crimp termination;

wherein said cable interface end of said insert includes at least one hole that receives a clamp fastener, and said clamp fastener engages said clamp termination of said double-sided contact;

wherein said mounting member includes a groove in a mounting surface thereof that receives a sealing member, said mounting surface faces said unit engagement end of said connector body;

wherein said cable interface end of said insert extends through and beyond said adapter engagement end of said connector body; and said unit interface end of said insert extends through and beyond said unit engagement end of said connector body.

11. A connector terminal according to claim 10, wherein said mounting member is an outwardly extending flange.

12. A connector terminal according to claim 10, further comprising another double-sided contact received in said inner bore of said insert, said another double-sided contact has one end that is a cable termination end configured to terminate to at least one conductor of the cable and an opposite end that is a unit termination end configured to terminate at least one conductor of the unit.

13. A connector terminal according to claim 10, wherein said adapter engagement end of said connector body includes outer threads for engaging corresponding threads of an adapter; and said unit engagement end of said connector body is sized for extending through an opening in the unit.

14. A connector terminal according to claim 10, wherein said cable termination end of said double-sided contact is different than said unit termination end.

15. A connector terminal according to claim 14, wherein said cable termination end is a clamp termination and said unit termination end is a crimp termination.

16. A connector terminal according to claim 15, wherein said cable interface end of said insert includes at least one hole that receives a clamp fastener, and said clamp fastener engages said clamp termination of said double-sided contact.

17. A connector terminal according to claim 10, further comprising at least one sealing member disposed inside said housing between said cable interface end of said insert and an inner surface of said housing.

18. A connector terminal according to claim 17, further comprising another sealing member supported by said mounting member at a mounting surface thereof, said mounting surface faces said unit engagement end of said connector body.

19. A connector terminal according to claim 18, wherein said cable securing end of said housing is configured to receive a nut member that is adapted to compress the cable.

20. A connector terminal according to claim 19, wherein a cable sealing member is received in said nut.

21. A method of assembling a connector terminal to a unit, the connector terminal including a unit-mountable connector and a cable sealing adapter, comprising the steps of:

terminating at least one conductor of the unit to a unit interface end of a double-sided contact of the unit-mountable connector;

mounting a connector body of the unit-mountable connector to the unit;

installing a cable by terminating at least one conductor of the cable to a cable interface end of the double-sided contact of the unit-mountable connector opposite the unit interface end of the double-sided contact; and assembling the cable sealing adapter on the cable after the step of installing the cable and mating an end of the cable sealing adapter with the connector body of the unit-mountable connector such that a cable interface end of the unit-mountable connector is received in the cable sealing adapter;

wherein said cable termination end is a clamp termination and said unit termination end is a crimp termination;

wherein said cable interface end of said insert includes at least one hole that receives a clamp fastener, and said clamp fastener engages said clamp termination of said double-sided contact;

wherein said mounting member includes a groove in a mounting surface thereof that receives a sealing member, said mounting surface faces said unit engagement end of said connector body;

wherein said cable interface end of said insert extends through and beyond said adapter engagement end of said connector body; and said unit interface end of said insert extends through and beyond said unit engagement end of said connector body.

22. A method according to claim 21, wherein the double-sided contact is one-piece and the cable sealing adapter is devoid of any contacts.

23. A method according to claim 21, further comprising the step of extending the unit engagement end of the connector body through an aperture of the unit.

24. A method according to claim 21, wherein the cable is a power cable.

25. A method according to claim 21, wherein the step of terminating at least one conductor of the unit occurs inside the unit and the step of installing the cable occurs outside the unit.

26. A method according to claim 25, wherein the end of the cable sealing adapter is threadably engaged with the connector body of the unit-mountable connector.

27. A method according to claim 21, wherein the step of terminating the at least one conductor of the unit to the unit interface end of the double-sided contact includes crimping the unit interface end.

28. A method according to claim 27, wherein the step of terminating the at least one conductor of the cable includes clamping the cable termination end of the double-sided contact.

29. A method according to claim 21, further comprising the step of abutting a mounting member of the connector body against the unit.

30. A method according to claim 29, further comprising the step of fastening the mounting member to the unit.

31. A method according to claim 30, wherein a sealing member is located between the unit and the mounting member.

* * * * *